US007497343B2

(12) United States Patent
Newman

(10) Patent No.: US 7,497,343 B2
(45) **Date of Patent: *Mar. 3, 2009**

(54) WALL HANGING GARAGE SHELF AND RACK STORAGE SYSTEM

(76) Inventor: Jared J. Newman, 5275 N. Five Mile Rd., Boise, ID (US) 83713

( * ) Notice: Subject to any disclaimer, the term of this patent is extended or adjusted under 35 U.S.C. 154(b) by 557 days.

This patent is subject to a terminal disclaimer.

(21) Appl. No.: 11/208,418

(22) Filed: Aug. 19, 2005

(65) Prior Publication Data

US 2006/0037923 A1 Feb. 23, 2006

Related U.S. Application Data

(63) Continuation-in-part of application No. 10/437,349, filed on May 12, 2003, now abandoned.

(60) Provisional application No. 60/400,439, filed on Aug. 2, 2002.

(51) Int. Cl.
*A47F 5/08* (2006.01)

(52) U.S. Cl. ..... 211/87.01

(58) Field of Classification Search ..... 211/87.01, 211/90.01, 105.4, 96–102, 94.01, 94.02; 248/235, 241, 250, 240.3
See application file for complete search history.

(56) References Cited

U.S. PATENT DOCUMENTS

| | | | |
|---|---|---|---|
| 0,913,228 | A | 2/1909 | McCarthy |
| 1,576,034 | A | 3/1926 | Butt |
| 1,982,972 | A | 12/1934 | Roosendael |
| 2,633,998 | A | 4/1953 | Derman et al. |
| 2,665,869 | A | 12/1954 | Samuels |
| 2,959,297 | A | 11/1960 | Larson |
| 3,146,732 | A | 9/1964 | Tozier |
| 3,184,068 | A | 5/1965 | Wende |
| 3,339,749 | A | 9/1967 | Odegaard |
| 3,468,426 | A | 9/1969 | Loewy |
| 4,209,098 | A | 6/1980 | Adams |
| 4,753,405 | A | 6/1988 | Camilleri |
| 4,809,941 | A | 3/1989 | Sheridan |
| 4,819,900 | A | 4/1989 | Funk |
| D304,137 | S | 10/1989 | Handler |
| 4,870,907 | A | 10/1989 | McKee |
| 4,936,467 | A | 6/1990 | Bobeczko |
| D335,234 | S | 5/1993 | Alguire |
| 5,224,609 | A | 7/1993 | Bauer et al. |
| 5,253,837 | A | 10/1993 | Loux |
| 5,351,842 | A | 10/1994 | Remmers |
| 5,441,161 | A | 8/1995 | Merl |

(Continued)

OTHER PUBLICATIONS

U.S. Appl. No. 11/212,984, filed Aug. 19, 2005, Jared J. Newman.

*Primary Examiner*—Jennifer E. Novosad
(74) *Attorney, Agent, or Firm*—Davis Wright Tremaine LLP; George C. Rondeau, Jr.

(57) ABSTRACT

A storage system capable of a variety of configurations and adaptations to be made based upon the necessities and desires of the user. The basic units of the device include at least two generally triangular shaped braces, a plurality of square shaped tubular rails, and a variety of attachment devices that allow for a variously adjustable tiered storage system with slidable suspension hooks that allow the device to be variously configured and modified without the use of tools.

8 Claims, 10 Drawing Sheets

U.S. PATENT DOCUMENTS

| | | | |
|---|---|---|---|
| 5,513,758 | A | 5/1996 | Lin |
| 5,526,941 | A | 6/1996 | Ford |
| 5,580,018 | A | 12/1996 | Remmers |
| D377,728 | S | 2/1997 | Klein |
| 5,647,490 | A | 7/1997 | Hull et al. |
| 5,711,430 | A | 1/1998 | Andersen |
| 5,740,927 | A | 4/1998 | Yemini |
| 5,857,577 | A | 1/1999 | Thomas |
| 5,897,002 | A | 4/1999 | Carlino |
| D411,701 | S | 6/1999 | Klein |
| 5,921,410 | A | 7/1999 | Emery et al. |
| D419,349 | S | 1/2000 | Klein |
| 6,145,678 | A | 11/2000 | Morrison |
| 6,152,312 | A | 11/2000 | Nava |
| 6,152,313 | A | 11/2000 | Klein |
| D444,377 | S | 7/2001 | Harvey |
| 6,257,425 | B1 | 7/2001 | Liu |
| 6,330,949 | B1 | 12/2001 | Derisio |
| 6,435,357 | B1 | 8/2002 | Lee |
| 6,561,364 | B1 | 5/2003 | Brunsden |
| 6,581,788 | B1 | 6/2003 | Winig et al. |
| 6,604,637 | B2 | 8/2003 | Lane et al. |
| 2001/0047974 | A1 | 12/2001 | Berlingieri |

WALL HANGING GARAGE SHELF AND RACK STORAGE SYSTEM

PRIORITY

This application claims priority from and is a continuation-in-part of U.S. patent application Ser. No. 10/437,349, which was filed on May 12, 2003 now abandoned by the same inventor and entitled Wall Hanging Garage and Rack Storage System. This application in turn claimed priority from a provisional patent application No. 60/400,439 entitled Wall Hanging Garage Shelf and Rack Storage System filed by Jared Newman on Aug. 2, 2002. The contents of all of these applications are hereby and herein incorporated by reference.

BACKGROUND OF THE INVENTION

1. Field of the Invention

The present invention generally relates to a system for storing and organizing tools and other items in a storage area. More particularly, the present invention relates to a wall mounted, removable and adjustable storage system for use in locations such as garages.

2. Background Information

Individuals accumulate items over the course of their lives. Many times these items are placed in an area of a person's home where they accumulate. Over time, these items may fall out of use or become lost. When a time arises that these items need to be retrieved, often times these items cannot be found. In addition, these accumulations of items can grow to the size that the area where the items in which they are stored cannot hold all of the items. This is particularly true in the case of a garage or a storage room, which is intended to store a particular item such as an automobile but over time, the accumulation and disorganization of materials in the storage area prevents the automobile from being stored in the garage. In order to overcome this problem, a variety of shelving and organizing systems exist. However, most of these organizing systems contain at least one of a variety of drawbacks.

One major drawback is that many types of the storage and organizing systems found in the prior art are inflexible. Most of the systems which currently exist are configured to be connected together and then installed in a single location in a single unchangeable configuration. Most of the time, once these systems are put into place and installed, the system is relatively fixed in this embodiment and configuration. This provides a significant disadvantage in that during the course of a period of time as short as one year, the desired configuration and orientation of storage system may need to be variously reconfigured in order to meet the needs and necessities of a user.

Another major drawback of many of the systems of the prior art is that they are configured to be constructed from the ground up. This type of system takes up valuable floor space, which then takes away the ability of an individual to perform many other activities within the same space. For example in a garage type of setting, the construction of such floor based types of devices take up valuable space such as the floor space around vehicle parking areas which must be kept clear in order to allow car doors to be opened and closed. Many times the construction and placement of these types of prior art systems causes the garage to become simply a storage room, and not a place where cars can be parked.

Another problem associated with the prior art systems is their rigidity and inflexibility of configuration. This does not allow for easily accessible changes to take place and reduces the value and utility of such systems. For example, in locations positioned in a temperate climate, the items to be stored in such a system vary. During the winter months in areas where snow is present, items such as skis, ski poles, sleds, snow shovels, and heavy winter clothing need to be both stored and readily accessible for use. During this same time of year, other items such as bicycles, garden hoses, lawn mowers, and garden tools need not be as readily accessible. However, as the temperature warms and the seasons change, the winter materials can be stored in a less readily accessible location and the warm weather materials need to be more readily accessible. In addition, the configuration of a storage system needs to be variously altered depending upon the accumulation of additional items or the loss of items. The configuration of most of the prior art systems requires that once a storage system is put in place, it is relatively fixed in place and cannot be easily reconfigured. This feature limits the usefulness of the storage system in that the system cannot be modified to accommodate items of varying sizes, weights and dimensions. In many instances, this then results in the storage system becoming obsolete because the system cannot be easily modified.

Therefore what is needed is a durable, convenient storage system that provides a variety of configurations and simple variations of the various configurations without the use of tools. What is also needed is a durable, convenient storage system that provides a variety of storage devices such as hooks, shelving, and horizontal and vertical suspension systems.

Accordingly, it is an object of the present invention to provide a durable, convenient storage system that can be variously reconfigured and adjusted into a variety of arrangements and configurations without the use of tools. It is also an object of the invention to provide a durable, convenient storage system that provides a variety of storage devices such as hooks, shelving, and horizontal and vertical suspension systems that provide a reliable, strong, and resilient organizing structure for an area such as a garage.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a shelf rack storage system that is variously adjustably configured so as to provide for a variety of configurations and adaptations to be made based upon the necessities and desired of the user. The invention is configured so that various features of the configuration can be adjusted and modified without the use of tools. As will be discussed below, this invention is more efficient in utilizing space than other systems in the prior art, is more easily modifiable than prior art storage systems, and can be economically produced and installed.

The fundamental units of the present device include at least two generally triangular shaped braces having attachment brackets configured to hold a plurality of generally square shaped tubular rails, a plurality of generally square shaped tubular rails, and a variety of attachment devices that are configured to connect with the generally square shaped tubular rails. Each of the generally triangular shaped braces in the invention is made up of a generally vertical wall connection portion, a generally horizontally disposed upper shelving portion, and a generally angled bracing portion. The generally vertical wall portion has a series of apertures and is configured to attach and connect to a portion of a wall with a fastening device such as lag screws. The generally horizontally disposed upper shelving portion is positioned generally perpendicular to the vertical wall portion and extends outward from the wall portion to provide a base for the placement of a shelf thereupon. In some embodiments, a front shelving lip may be connected to the upper shelving portion and provides additional support both to a shelving piece that is placed upon the upper portion and to adjacent bracing portions. A generally angled bracing portion extends between the generally vertically positioned wall connecting portion and the generally horizontally disposed upper shelving portion. This bracing portion has a plurality of brackets spatially positioned along the bracing portion. Each of these brackets is configured to connect with a portion of a hanging rail so as to suspend the hanging rails in several horizontal and vertical tiers.

In one embodiment of the invention these brackets are L-shaped pieces of material that are welded or otherwise fixedly connected to the angled bracing portions. In the preferred embodiment of the invention, these brackets are apertures, which are defined with in the generally angled bracing portions themselves. The hanging rails, which are configured for insertion within these brackets may be held in place by either the force of gravity against the brackets themselves or by an actual stop means. In the preferred embodiment of the invention, the hanging rails contain a resiliently compressible finger, which may be compressed so as to allow the hanging rail to be inserted within the aperture. This finger also extends after passing through the aperture so as to form a stop, which prevents the rail from being pulled back out of the aperture. In embodiments of the invention, these hanging rails may be configured with ends which allow sections of these rails to be interconnected by inserting a portion of a first rail within a receiving portion of a second rail. A holding device, which in some instances may be a compressible finger may be utilized in such an embodiment to hold the first and second rails together in a desired position and orientation.

The hanging rails are configured to receive a variety of attachment devices in sliding and/or removable connection along these rails. These attachment devices can be configured in a variety of ways, however most preferably these connection devices are configured for connection with hanging devices in such a way so as to prevent these attachment devices from rotating from a desired position along the rails. Additionally, the rails themselves may be removed from their connection with the brackets, and replaced in a different desired position so as to increase the various modifiable functions and features of the invention.

The attachment devices that are configured to connect with the hanging rails include a variety of storage devices such as single prong hooks, dual prong hooks, shelving systems, and other devices. These attachment devices are configured to connect with the hanging rails in an embodiment wherein the hooks are maintained in a desired orientation and position along the rail. In one embodiment of the invention, this is done by utilizing a generally square tubular shaped rail and having connection devices that are configured to be placed over the rails in a manner so that three sides of the generally square shaped tubing are contacted by a portion the attachment device. Such a configuration prevents the connection devices from rotating around the hanging rails when an item is placed upon the hooks or other connection devices.

A variety of hooks, storage, and support devices can be configured for placement upon the rails. This includes single hooks, double hooks as well as grasping type holders for brooms, garden tools, bicycles, skis and other devices. In addition to these devices, nearly any other type of typical storage device that is configured to hang or suspend an item upon a rack may be utilized. Another type of connection device that can be configured for connection with the device is a shelf. This shelf has a pair of connection devices that are configured to connect with a hanging rail that is suspended in an upper position. The shelf also has a pair of support brackets that are each configured to connect to a lower hanging rail and support the shelf from below. This shelf, like the other attachment devices, can be alternatively placed and removed from its position upon the hanging rails so as to accommodate items of various sizes, weights and dimensions. In addition, the hanging rails can also be removed and replaced from a variety of locations so as to provide desired configurations.

The use of this system frees up floor space so as to allow more efficient utilization of space and in the case of a garage, allows cars to enter and exit the garage freely. The present invention provides a removable, easily adjustable tiered system for storing items utilizing space that would otherwise be unused. This provides a variety of advantages over the other storage systems that exist in the prior art. The present invention also provides an easily reconfigurable system for organizing materials in a desired position, location, and orientation. The shelf/rack storage system has the latitude to reorganize a garage by simply moving the hanger hooks to one side or another, or to variously add or remove hanging rails to accommodate storage of pieces having various shapes and sizes.

The purpose of the foregoing abstract is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

BRIEF DESCRIPTION OF THE DRAWINGS

FIG. 2A is a detailed rotated perspective view of the L-shaped bracket shown in FIG. 2.

FIG. 2B is a detailed side view of the connection between the upper shelving portion of the brace and the angled shelving connector shown in FIG. 2.

DESCRIPTION OF THE PREFERRED EMBODIMENTS

Figure 1:
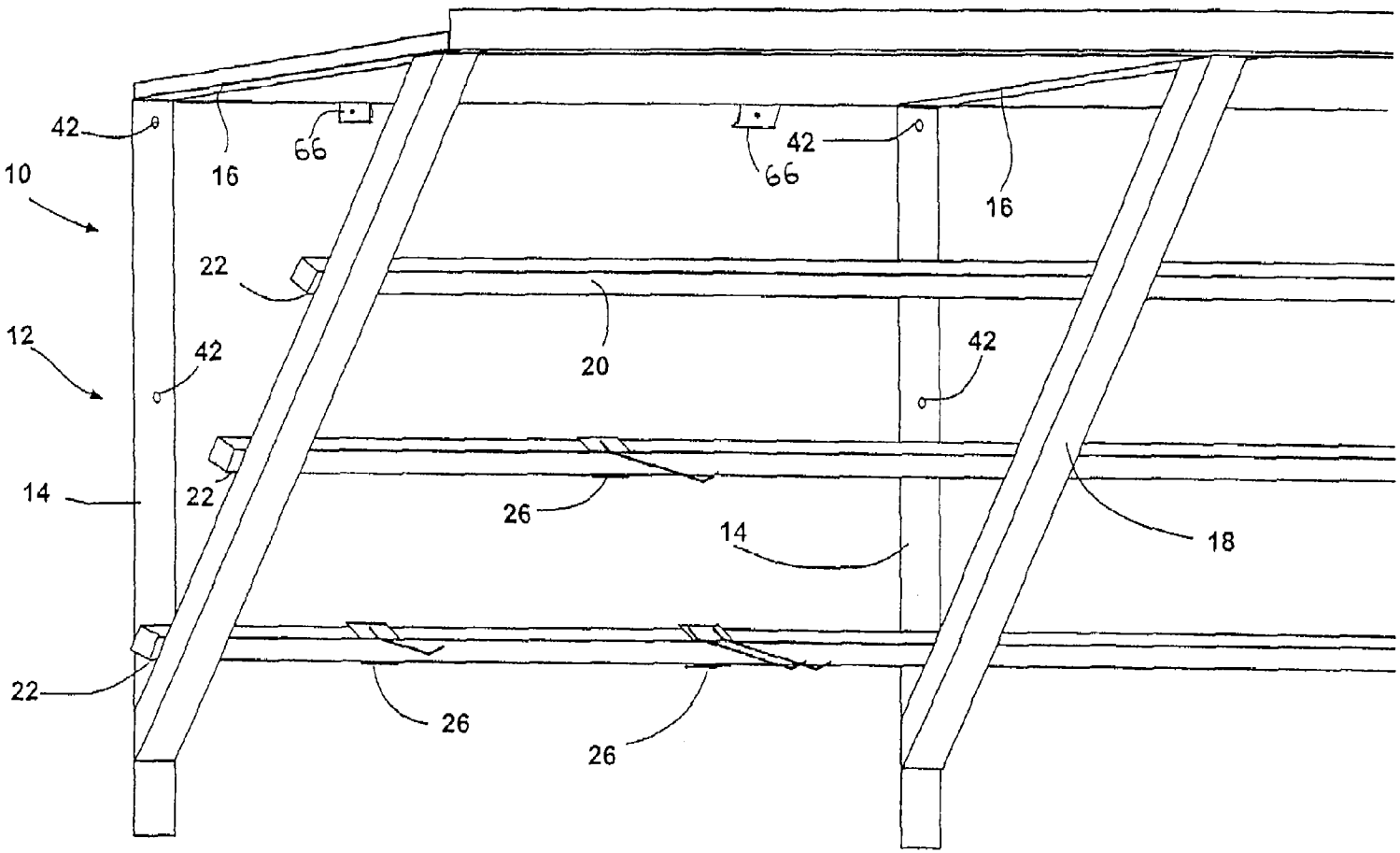
FIG. 1 is a perspective view of a first embodiment of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a shelf rack storage system that is variously adjustably configured so as to provide for a variety of configurations and adaptations to be made based upon the necessities and desires of the user. The invention is configured so that various features of the configuration can be variously adjusted and modified without the use of tools.

Referring now to FIGS. 1-6, various features of the preferred embodiment are shown. FIG. 1 shows a perspective view of a first embodiment of the invention 10. A set of at least two braces 12, 12' are connected to a stable portion of a structure such as a garage wall. Each of the braces 12, 12' are comprised of a generally vertical wall connecting portion 14, an upper shelving support portion 16, and an angled bracing portion 18. In the preferred embodiment, the upper shelving support portion 16 and the generally vertical wall-mounting portion 14 are configured in a generally inverted L-shaped arrangement from a generally flat piece of material, preferably a steel bar which is bent at a ninety-degree angle. The wall-mounting portion 14 also contains a plurality of apertures 42 that are configured to allow passage of an anchoring device such as a lag screw therein.

Figure 5:
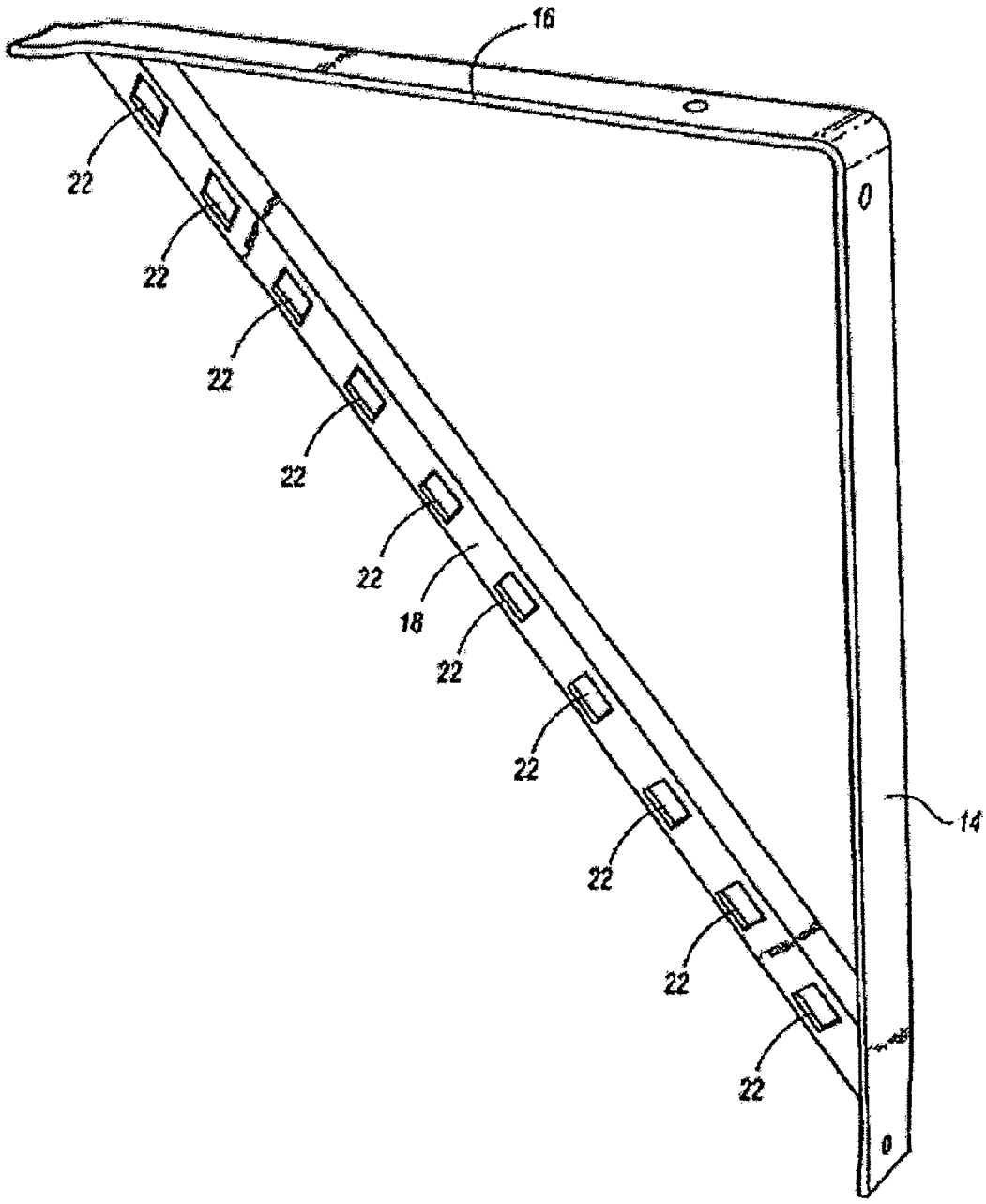
FIG. 5 is an example of the preferred bracing device utilized in the present invention.
Figure 6:
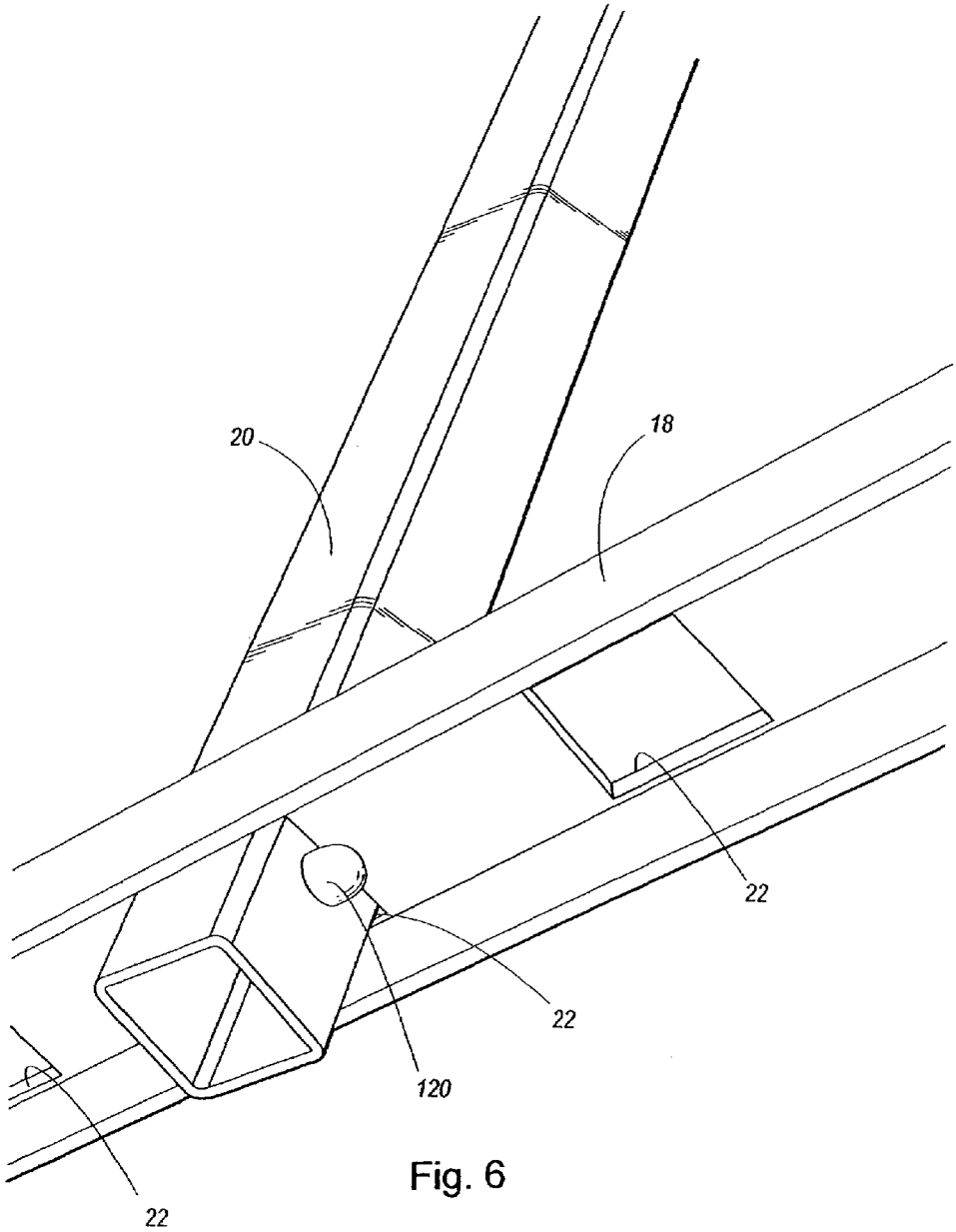
FIG. 6 is a detailed view of the preferred hanging rail and brace which are present in the present invention.

An angled bracing rail 18 extends between the upper shelving support portion 16 and the vertical wall mount portion 14, thus forming a generally triangular shape. This bracing rail 18 is a piece of a material that is cut to intersect the upper shelving support and the wall-connecting portion at an angle of about forty-five degrees. The bracing rail 18 is welded to the upper shelving support portion 16 as well as to the generally vertical wall connection portion. In the preferred embodiment of the invention, a series of generally square shaped apertures 22, shown in FIGS. 5-6 are defined within the angled bracing portion of the brace. A detailed view of this embodiment is shown in FIGS. 5-6, which are discussed below in detail.

FIGS. 5-6 show that the bracket apertures 22 are configured to receive a portion of a generally square shaped tubular hanging rail 20 therein. These generally square shaped tubular rails 20 are then configured to support and suspend a variety of hanging storage devices 26 in various desired positions, locations, and orientations. In the preferred embodiment of the invention, these generally squared tubular hanging rails 20 contain a selectively compressible finger 120 which is configured so as to be resiliently pushed outward away from the center portion of the hanging rail 20 itself. However, these compressible fingers are also able to be pushed downward when pressure is applied to them thus allowing the hanging rails 20 to more easily fit through the bracket apertures 22. Once these tubular portions have been passed through these apertures these fingers can then extend themselves into another desired location and position so as to prevent the rails from being pulled back through the apertures 22. These hanging rails 20 can be used both with these bracket apertures 22 of the preferred brackets as well as with the L-shaped brackets which have been shown and described in the parent patent application.

Figure 2:
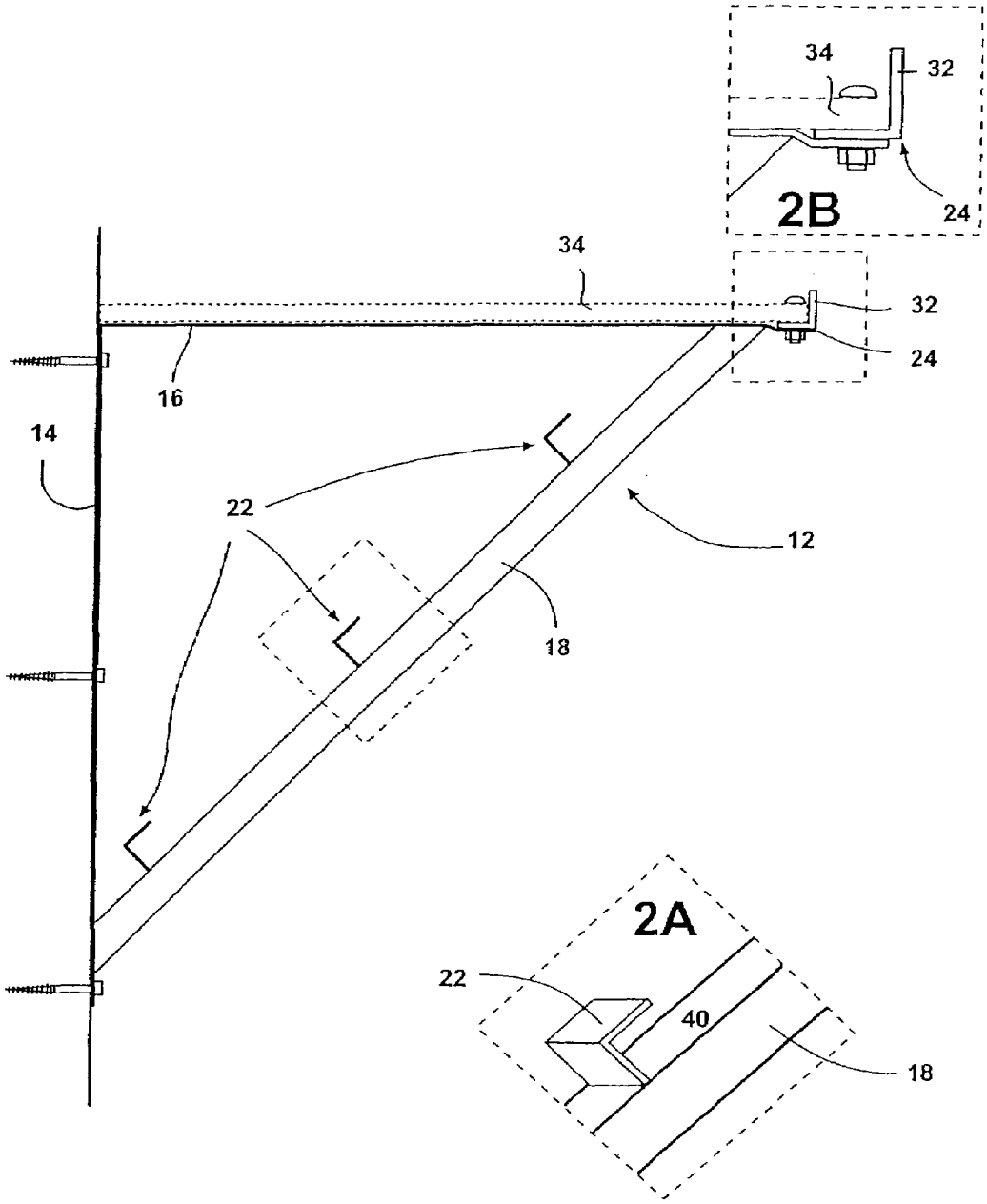
FIG. 2 is a detailed side view of the embodiment shown in FIG. 1.
Figure 3A:
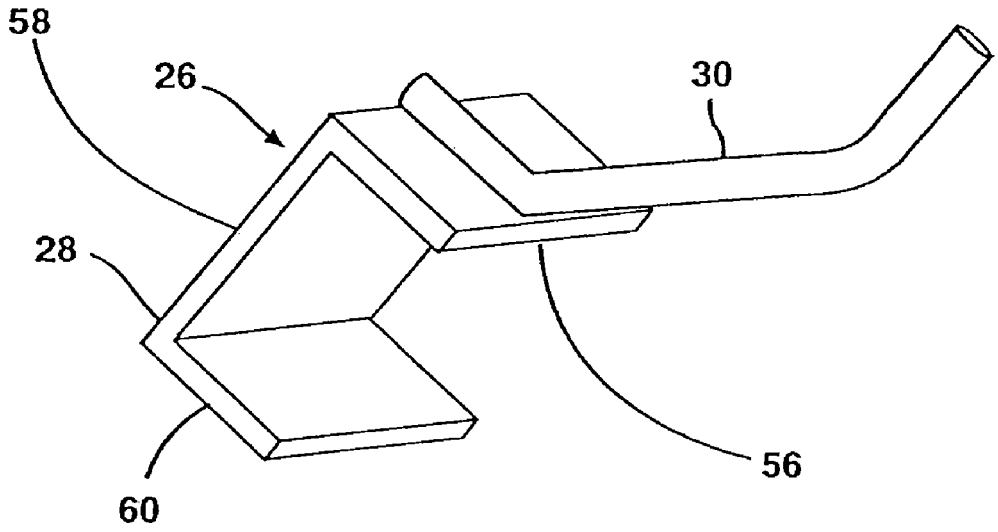
FIGS. 3A-3E are views of various attachment devices utilized in the present invention.
Figure 3B:
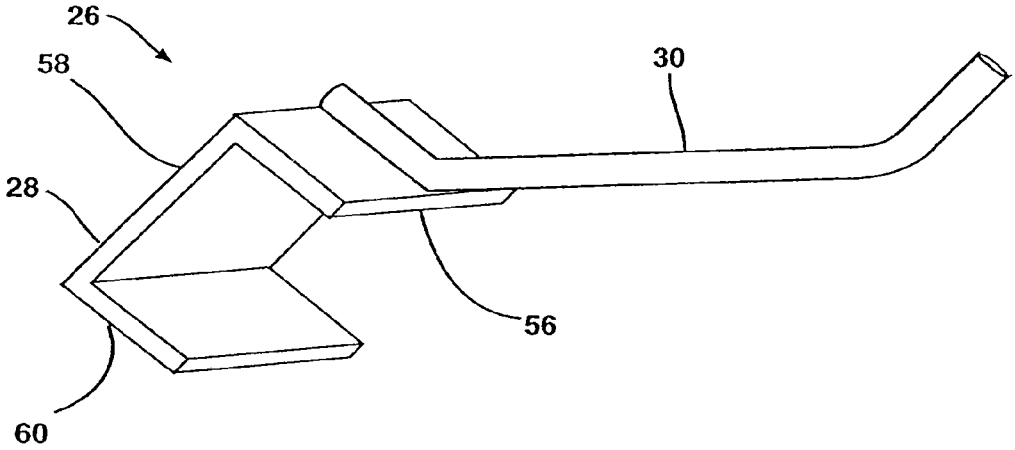
Figure 3C:
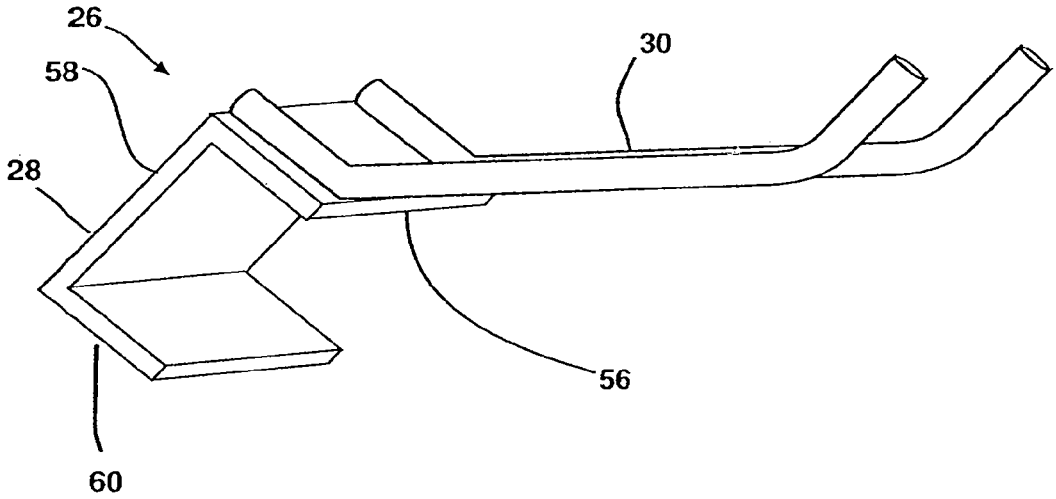
Figure 3D:
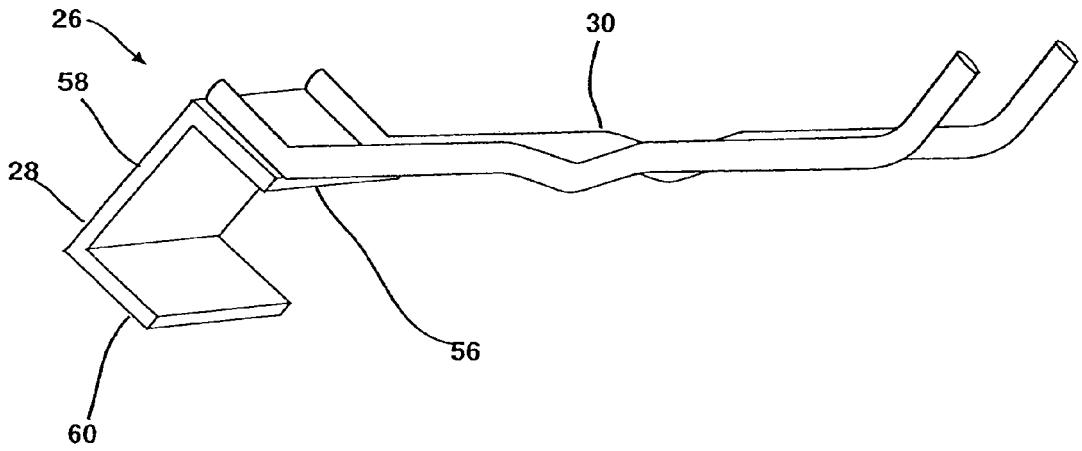
Figure 3E:
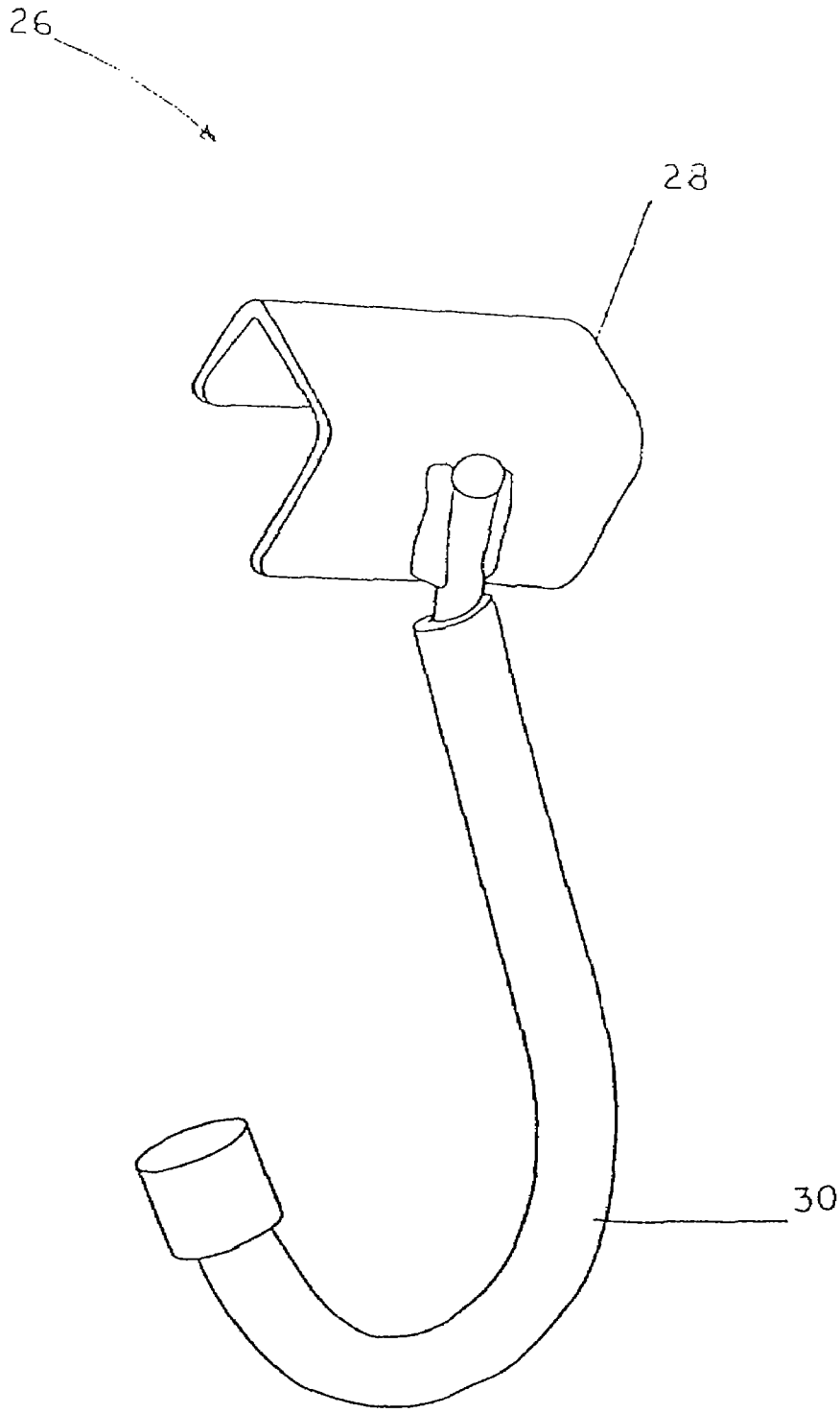

Referring now to FIGS. 2 and 2A, a detailed side view of the embodiment shown in FIG. 1 is shown. The braces 12 are installed by connecting the wall-mounting portion of the device 14 to a wall utilizing a sturdy connection device such as lag screws, which are inserted through apertures within the wall-mounting portion 14. The amount of weight that can be supported and the stability of the device 10 are greater when the braces 12 are mounted to the studs, or other sturdy portions of the wall. This configuration is preferred.

The upper shelving portions 16 of the brace 12 are configured to form a support for a shelf, which sits upon these upper shelving portions 16 so as to form a support. The shelving materials 34 which are utilized to support and hold this shelf may be formed of any variety of materials such as wood, metal, plastic, or a composite material. This configuration allows the shelving material 16 to sit in a desired generally level horizontal orientation across the upper shelving support portion 16 of the braces 12.

As is shown in FIG. 1, a variety of hanging rails 20 can be placed upon the shelving braces 12 in a variety of configurations so as to accommodate and store a variety of devices. The length of the hanging rails 20 can be varied so that these modifications can be more easily made. Because the hanging rails 20 simply slip into and out of the brackets 22, these hanging rails 20 can be added and removed as needed in order to accommodate storage of a variety of items and devices. In addition, in some embodiments of the invention the square tubular handing rails can be interconnected. In the typical embodiment, the hanging rails 20 are approximately 48 forty eight inches in length and can be set within any one of a plurality of bracket connections and holding devices so as to form various tiers upon which the device will be placed.

In the preferred embodiment, three rows of hanging rails 20 provide three different horizontal and vertical tiers that assist both the storage and retrieval of items from a stored position. Each of these tiers lies in a different horizontal and vertical plane as compared to any of the other tiers. While in this preferred embodiment three brackets are shown, it is to be distinctly understood that this configuration is intended to be illustrative only and not limiting. The number, spacing, and overall dimensions of the brackets, as well as the other features of the present invention, are dependent upon the necessities and desires of a user. Therefore, the description of the present invention is intended to be seen as illustrative in nature and not as restrictive.

These varied tiers allow for various levels or planes of items in which attachment devices 26 may attach and items may be stored. These attachment devices 26 are configured to attach to the hanging rail 20 in a variety of stable preferably non-rotating positions. This attachment device 26 is configured for placement along the hanging rails so as to provide a desired horizontal position of the item to be stored.

The attachment devices 26 may be adjusted by sliding the attachment device 26 along a rail 20 and may also be removed and replaced from connection with the hanging rails 20. The types of items to be stored and the configuration for storing such items may be varied according to the necessities of the user. Some of the attachment devices 26 that are configured to connect with the hanging rails 20 include a variety of storage devices such as single prong hooks, dual prong hooks, j-type hooks, traditional bicycle supporting type of hooks, shelving systems, and other devices. Examples of some of the attachment devices utilized in this preferred embodiment are shown in FIGS. 3A-3E. While a plurality of attachment devices are shown in these figures, these illustrated items are not intended to be an exhaustive list and it is recognized that a variety of other types of connection devices may also be utilized as a part of the present invention. Thus, it is to be understood that the present description of attachment devices 26 is intended to be illustrative in nature and not as limiting.

Referring now to FIGS. 3A-3E, a variety of configurations of attachment devices 26 are shown. These attachment devices 26 are each configured to connect with the hanging rails 20 in such a manner that the hook portions 30 of the device are maintained in a desired orientation and position along the rail 20. In one embodiment of the invention, this is done by utilizing a generally square tubular shaped hanging rail 20 having rail connecting portions 28 that are configured to be correspondingly configured to be placed over these rails 20. In the preferred embodiment, the rail attaching portions 28 are configured to be placed over a rail 20 having made of one inch square tubing. The rail attaching portions 28 are configured to have a first portion 56 that extends over front side of the rail, a second portion 58 that extends over a back section of a rail, and a third portion 60 that extends over a bottom section of a rail. These pieces are configured to have respective dimensions of 1", 1" and ¾". Such a configuration prevents the connection devices 26 from rotating around the hanging rails 20 when an item is placed upon the hooks 30 or other connection devices.

The devices shown in FIGS. 3A-3E also include a variety of types of hooks that may be utilized in the present invention to suspend a variety of items. These include single pronged hooks and double pronged hooks having a variety of lengths, features, and configurations and which are intended and configured to suspend and hold a variety of items. In addition to the hooks disclosed in FIG. 3, it is to be distinctly understood that a variety of other types of connection devices may also be utilized in the present invention and are included within the scope of this disclosure. Such items include grasping mechanisms, racks, shelves, magnets, strings or any other mechanism that can be suitable mounted to a rail connecting piece 28 and connected to the hanging rails 20 of the present invention.

Figure 4:
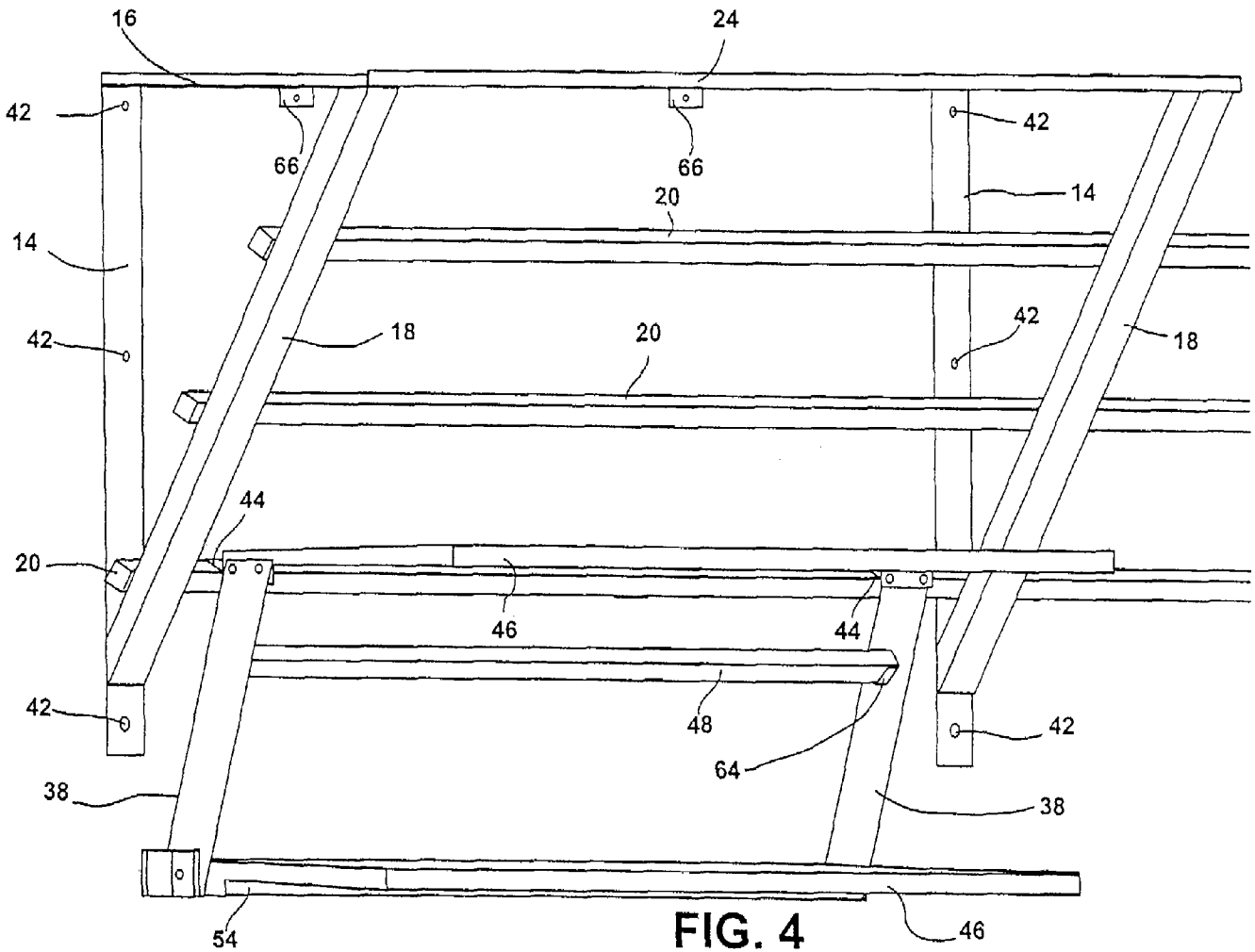
FIG. 4 is a detailed view of a shelf connection that is used in the present preferred embodiment.

FIG. 4 shows another type of attachment device 46 that may be utilized in the present invention. FIG. 4 shows a hanging shelf 46 that is configured for connection with the hanging tiers 20 of the present embodiment. This shelf 46 has a pair of connection devices 44 that are configured to connect with a hanging rail 20 that is suspended in an upper position. Such a shelf 46 is maintained in a desired vertical orientation by the attachments brackets 28 and can be utilized in the configuration to hold items accumulating up to about 60 lbs. In the preferred embodiment, a second shelf 46' is also connected to the first shelf 46 through a connection bracket 38. This connection bracket 38 is comprised of a pair of vertically extending supports 62 that are interconnected by a bar 54 that is welded between the two supports 62. A second shelf 46' extends from between the vertically extending support brackets 38 and is connected to the welded bar 54 by the same type of attachment devices 28 as those that are utilized to attach the other types of attachment devices 26 to the rails 20. In some embodiments, these lower vertically extending support brackets 38 may be attached to the wall and support the shelf 46' in a desired manner and orientation. These lower shelves 46' and bars 48, 54 can also be utilized to support additional lower attachment devices 26.

In the preferred embodiment, the vertically extending supports 62 each have side support brackets 64. These side support brackets 64 are configured to receive and hold a portion of a shelf connecting bar 48 therein. These shelf-connecting bars 48 are similar in configuration to the hanging rails 20 that are used in the other portions of the invention. The shelf connecting bar 48 is configured to be alternatively placed and removed from its position upon side support brackets 64 so as to provide for the attachment of storage type hooks in a variety of varied adjustable storage positions. For example in one embodiment the device could be configured to have a shelf 46' positioned shelf for holding shoes, while the hooks were attached to the shelving connection bar 48 for hanging coats. While in this embodiment, one shelf 46 is shown as suspended from a hanging rail 20 the invention is not limited to this embodiment but may also be embodied so that the shelves extend in progressive downward connection toward a floor.

In the preferred embodiment, all of the surfaces of the braces 12, the rails 20, and the attachment devices 26 are covered with a material that prevents rusting and staining of the items being stored. This is preferably done with a system such as dipping or powder coating the pieces to achieve this desired result. However, it is to be distinctly understood that a variety of other systems may also be utilized. In addition, the hook portions are coated with a wear resistant material such as polyethylene or another type of plastic coating that prevents the coating from being rubbed off of the hooks as materials are placed upon and removed from the device. For safety as well as to protect the internal portions of the device, the end portions of the hanging rails 20 may be fitted with tight fitting plastic caps or plugs.

This invention utilizes space that would otherwise not be utilized. By utilizing a variety of horizontal and vertical tiers, the present invention allows for items to be suspended and stored in a manner that utilizes significantly less space than other systems seen in the prior art. In addition, by utilizing attachment devices 26 which can be positioned anywhere along the hanging rails 20, the configuration can be easily modified to accommodate items of various shapes and positions. This flexibility can be further achieved by removing and replacing the hanging rails 20 to accommodate and achieve storage space sufficient to hold pieces that have a various shapes.

While there is shown and described, the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A system configured for organizing and storing items and for support by a structural wall, the system comprising:

a shelf;

a hanging rail having spaced apart supportable portions with an intermediate portion therebetween;

at least two braces, each of the two braces having a wall connection portion configured to connect with a portion of the structural wall, a shelf supporting portion configured to support the shelf in a generally horizontally disposed position, and a bracing portion extending upward from the wall connection portion to the shelf supporting portion, each of the bracing portions including a plurality of rail support apertures at different positions along a length of the bracing portion, the rail support apertures being located at corresponding positions along the bracing portions of the two braces, correspondingly positioned ones of the rail support apertures each being configured to non-rotatably and removably receive therein one of the supportable portions of the hanging rail and support the hanging rail in a generally horizontal position extending between the correspondingly positioned ones of the rail support apertures and the two braces; and at least one attachment member configured to support at least one of the items, the at least one attachment member being configured to non-rotatably and removably engage the intermediate portion of the hanging rail to support the at least one attachment member in a position between the two braces.

2. The system of claim 1 wherein the rail support apertures are each configured to fully encircle one of the supportable portions of the hanging rail when received therein.

3. The system of claim 1 wherein the at least one attachment member has a rail connection portion with a downward opening to removably and non-rotatably receive the intermediate portion of the hanging rail therein.

4. The system of claim 3 wherein the rail connection portion is slidably mounted on the intermediate portion of the hanging rail for selective sliding therealong for positioning of the at least one attachment member at a selected position between the two braces.

5. The system of claim 1 wherein the supportable portions of the hanging rail have a non-circular cross-sectional shape, and the rail support apertures each have a non-circular cross-sectional shape conforming at least in part to the non-circular cross-sectional shape of the supportable portions and with a size to non-rotatably retain therein one of the supportable portions of the hanging rail.

6. The system of claim 1 wherein the bracing portions of the two braces each has a lower end portion attached to the wall connection portion and an upper end portion attached to the shelf supporting portion, and a straight length intermediate portion with the plurality of rail support apertures positioned therealong, the intermediate portion of the bracing portion being disconnected from the wall connection portion and the shelf supporting portion and solely directly supported by the lower end portion and the upper end portion of the bracing portion.

7. The system of claim 1 wherein the hanging rail has a uniform square cross-sectional shape along its full length, and the rail support apertures each have a square cross-sectional shape sized to receive and non-rotatably retain therein one of the supportable portions of the hanging rail.

8. The system of claim 1 wherein each of the supportable portions of the hanging rail has an end portion extending laterally outwardly therefrom and past the bracing portion having the rail support aperture within which received when the supportable portions of the hanging rail are received in correspondingly positioned ones of the rail support apertures, each end portion including a locking member positioned laterally outward of the bracing portion, the locking member being movable between an extended locked position and a depressed unlocked position, the locking member when in the depressed unlocked position allowing the hanging rail end portion to pass through the rail support aperture to position the locking member on a laterally outward side of the bracing portion, and when in the extended locked position and on the laterally outward side of the bracing portion, the locking member being sized to engage the bracing portion to limit laterally inward movement of the hanging rail.

* * * * *